US006223358B1

(12) United States Patent
DePietro

(10) Patent No.: US 6,223,358 B1
(45) Date of Patent: May 1, 2001

(54) CONVERTIBLE POOL COVER SUPPORT

(76) Inventor: Charles M. DePietro, 6 Benton Ct., Staten Island, NY (US) 10306

( * ) Notice: Subject to any disclaimer, the term of this patent is extended or adjusted under 35 U.S.C. 154(b) by 0 days.

(21) Appl. No.: 09/477,850

(22) Filed: Jan. 5, 2000

(51) Int. Cl.[7] ..... E04H 4/00; A63B 67/00

(52) U.S. Cl. ..... 4/498; 473/466; 248/157; 248/161

(58) Field of Search ..... 248/125.8, 161, 248/159, 163.1, 345; 4/496, 498, 503; 473/466

(56) References Cited

U.S. PATENT DOCUMENTS

| | | | | |
|---|---|---|---|---|
| 3,794,322 | * | 2/1974 | Rosekrans, Jr. | 273/95 R |
| 4,251,889 | | 2/1981 | Lof | 4/498 |
| 4,257,132 | | 3/1981 | Kerby | 4/498 |
| 4,951,327 | * | 8/1990 | Del Gorio, Sr. | 4/498 |
| 5,303,527 | * | 4/1994 | Perez et al. | 4/498 |
| 5,371,907 | * | 12/1994 | Horvath | 4/498 |
| 5,615,891 | * | 4/1997 | Pankz | 473/492 |
| 5,687,432 | * | 11/1997 | Genzel | 4/498 |
| 5,706,531 | * | 1/1998 | Aubertine | 4/498 |
| 5,901,503 | | 5/1999 | Dalene et al. | 52/2.11 |
| 5,970,531 | * | 10/1999 | Demby | 4/498 |
| 6,119,284 | * | 9/2000 | Cosman | 4/498 |
| 6,155,937 | * | 12/2000 | Alter | 473/469 |

* cited by examiner

*Primary Examiner*—Leslie A. Braun
*Assistant Examiner*—Steven Marsh
(74) *Attorney, Agent, or Firm*—Goldstein & Canino

(57) ABSTRACT

A convertible pool cover support including a fixed support portion positionable within the pool. A pool cover supporting portion is couplable with the fixed support portion for supporting a pool cover at an elevation with respect to the pool. A pair of corner pads are positionable on the pool cover supporting portion. The corner pads have a plurality of securement straps extending outwardly therefrom. A volleyball net portion is adapted for coupling with the fixed support portion when the pool cover supporting portion is removed therefrom.

6 Claims, 4 Drawing Sheets

CONVERTIBLE POOL COVER SUPPORT

BACKGROUND OF THE INVENTION

The present invention relates to a convertible pool cover support and more particularly pertains to supporting an above-ground pool cover in an elevated position on a pool and converting into volleyball net for use in the pool.

Typical swimming pool covers effectively cover swimming pools, but tend to allow water and debris to accumulate thereon which tends to stretch out the cover or otherwise cause irreparable damage thereto. Improvements have been made to pool covers in the form of support structures that serve to elevate the pool cover, while at the same time covering the swimming pool, so as to prevent any water or debris from accumulating on the pool cover. When not in use, these support structures typically have no other use. Since the use of games and the like are commonplace with swimming pools, making an effort to convert these support structures into a useful game would seem like a sensible idea.

The present invention attempts to solve the abovementioned problem by providing a pool cover support that can also easily convert into a volleyball net for use in the swimming pool.

The use of pool covers is known in the prior art. More specifically, pool covers heretofore devised and utilized for the purpose of covering swimming pools are known to consist basically of familiar, expected and obvious structural configurations, notwithstanding the myriad of designs encompassed by the crowded prior art which have been developed for the fulfillment of countless objectives and requirements.

By way of example, U.S. Pat. No. 5,371,907 to Horvath discloses a pool cover support for supporting a pool cover above a pool. U.S. Pat. No. 4,251,889 to Lof discloses a swimming pool cover that overhangs several inches over the pool for securement of foamed plastic cylinders therein. U.S. Pat. No. 4,257,132 to Kerby discloses a collapsible pool cover assembly including a plurality of slidably extendable support members. U.S. Pat. No. 5,901,503 to Dalene et al. discloses a swimming pool dome comprised of a plurality of inflatable sections.

While these devices fulfill their respective, particular objective and requirements, the aforementioned patents do not describe a convertible pool cover support for supporting an above-ground pool cover in an elevated position on a pool and converting into volleyball net for use in the pool.

In this respect, the convertible pool cover support according to the present invention substantially departs from the conventional concepts and designs of the prior art, and in doing so provides an apparatus primarily developed for the purpose of supporting an above-ground pool cover in an elevated position on a pool and converting into volleyball net for use in the pool.

Therefore, it can be appreciated that there exists a continuing need for a new and improved convertible pool cover support which can be used for supporting an above-ground pool cover in an elevated position on a pool and converting into volleyball net for use in the pool. In this regard, the present invention substantially fulfills this need.

SUMMARY OF THE INVENTION

In the view of the foregoing disadvantages inherent in the known types of pool covers now present in the prior art, the present invention provides an improved convertible pool cover support. As such, the general purpose of the present invention, which will be described subsequently in greater detail, is to provide a new and improved convertible pool cover support which has all the advantages of the prior art and none of the disadvantages.

To attain this, the present invention essentially comprises a fixed support portion comprised of a pair of inverted T-shaped members. Each of the inverted T-shaped members include a lower horizontal portion and an upper vertical portion. The lower horizontal portions each have a pair of anchor holes therethrough. The upper vertical portions each have a plurality of vertically aligned apertures therethrough. A pool cover supporting portion is provided that is comprised of a third inverted T-shaped support positionable between the pair of inverted T-shaped members of the fixed support portion. The third inverted T-shaped support includes a lower horizontal portion and an upper vertical portion. The upper vertical portion has a plurality of vertically aligned apertures therethrough. The pool cover supporting portion includes a pair of L-shaped members each having lower vertical portions and upper horizontal portions. The lower vertical portions and the upper horizontal portions each have linearly aligned apertures therethrough. The lower vertical portions each have open lower ends for coupling with the upper vertical portions of the inverted T-shaped members of the fixed support member with aligned apertures thereof receiving cotter pins. The upper horizontal portions each have open inner ends. The pool cover supporting portion includes a central T-shaped member comprised of an upper horizontal portion and a lower vertical portion. The upper horizontal portion of the central T-shaped member has linearly aligned apertures therethrough and opposed ends. The opposed ends are receivable within the open inner ends of the upper horizontal portions of the L-shaped members with the apertures thereof aligning for receiving cotter pins. A pair of corner pads are provided that are positionable on the pair of L-shaped members of the pool cover supporting portion. The corner pads have a plurality of securement straps extending outwardly therefrom. A plurality of securement straps are provided that are extendable over the pool cover supporting portion for securement thereof within an interior of a swimming pool. A plurality of securement clamps are provided that are adapted for securing a pool cover to the swimming pool. A volleyball net portion is provided that is adapted for coupling with the fixed support portion. The volleyball net portion includes a pair of vertical poles each having open lower ends for receiving the upper vertical portions of the fixed support portion.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved convertible pool cover support which has all the advantages of the prior art pool covers and none of the disadvantages.

It is another object of the present invention to provide a new and improved convertible pool cover support which may be easily and efficiently manufactured and marketed.

It is a further object of the present invention to provide a new and improved convertible pool cover support which is of durable and reliable construction.

An even further object of the present invention is to provide a new and improved convertible pool cover support which is susceptible of a low cost of manufacture with regard to both materials and labor, and which accordingly is then susceptible of low prices of sale to the consuming public, thereby making such a convertible pool cover support economically available to the buying public.

Even still another object of the present invention is to provide a new and improved convertible pool cover support for supporting an above-ground pool cover in an elevated position on a pool and converting into volleyball net for use in the pool.

Lastly, it is an object of the present invention to provide a new and improved convertible pool cover support including a fixed support portion positionable within the pool. A pool cover supporting portion is couplable with the fixed support portion for supporting a pool cover at an elevation with respect to the pool. A pair of corner pads are positionable on the pool cover supporting portion. The corner pads have a plurality of securement straps extending outwardly therefrom. A volleyball net portion is adapted for coupling with the fixed support portion when the pool cover supporting portion is removed therefrom.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various figures.

DESCRIPTION OF THE PREFERRED EMBODIMENT

Figure 1:
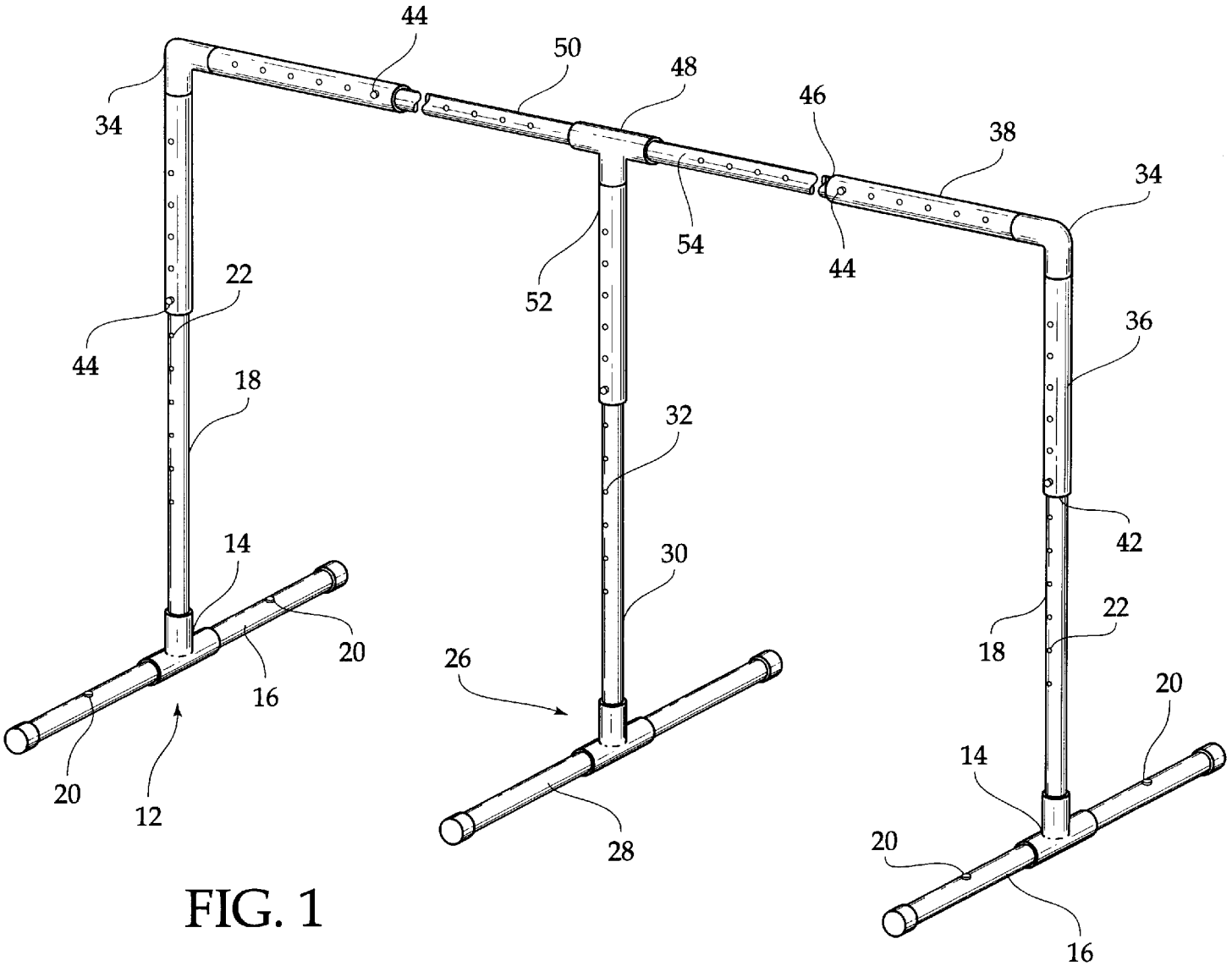
FIG. 1 is a perspective view of the preferred embodiment of the convertible pool cover support constructed in accordance with the principles of the present invention.
Figure 2:
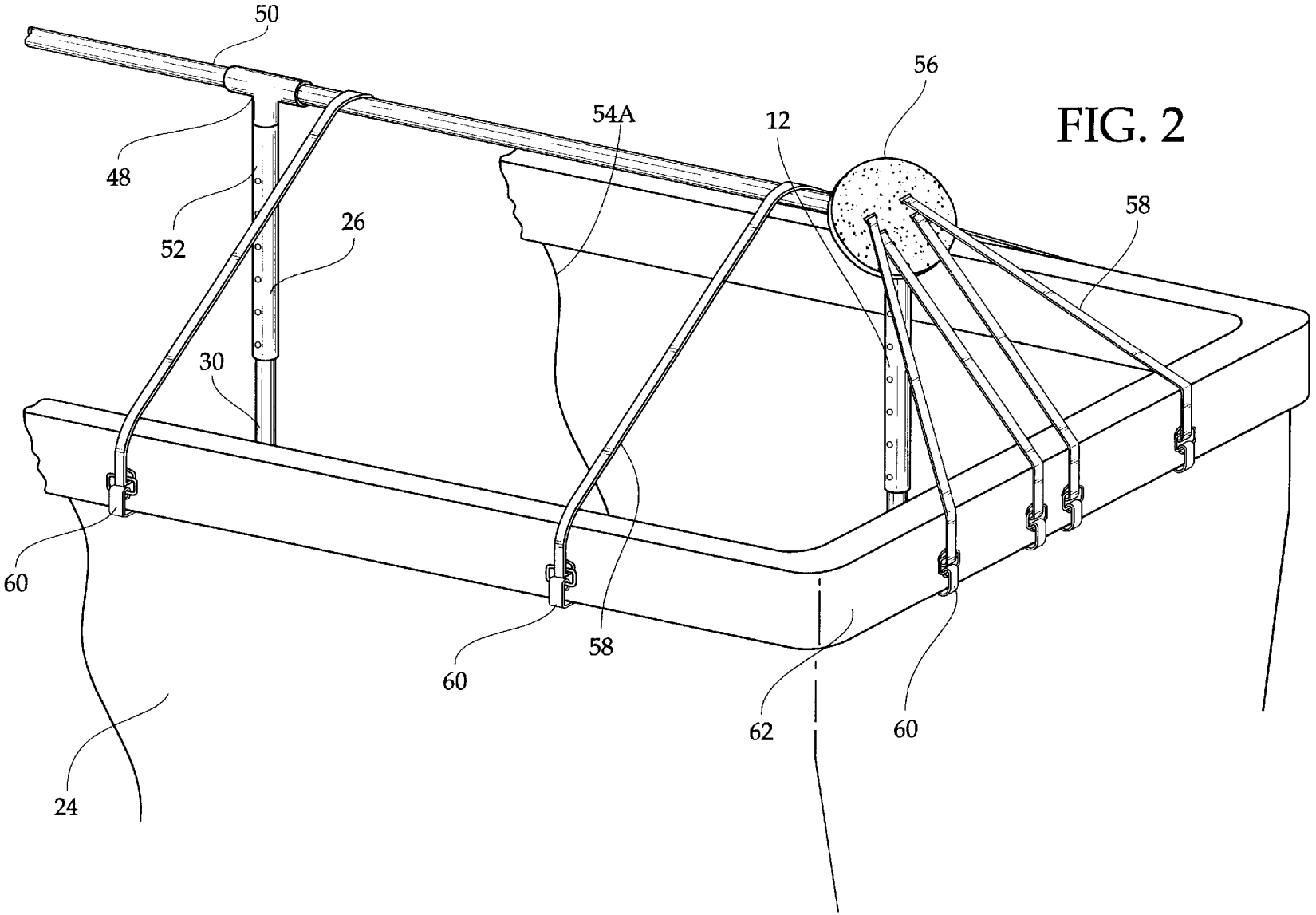
FIG. 2 is a perspective view of the present invention illustrated in use within a swimming pool.
Figure 3:
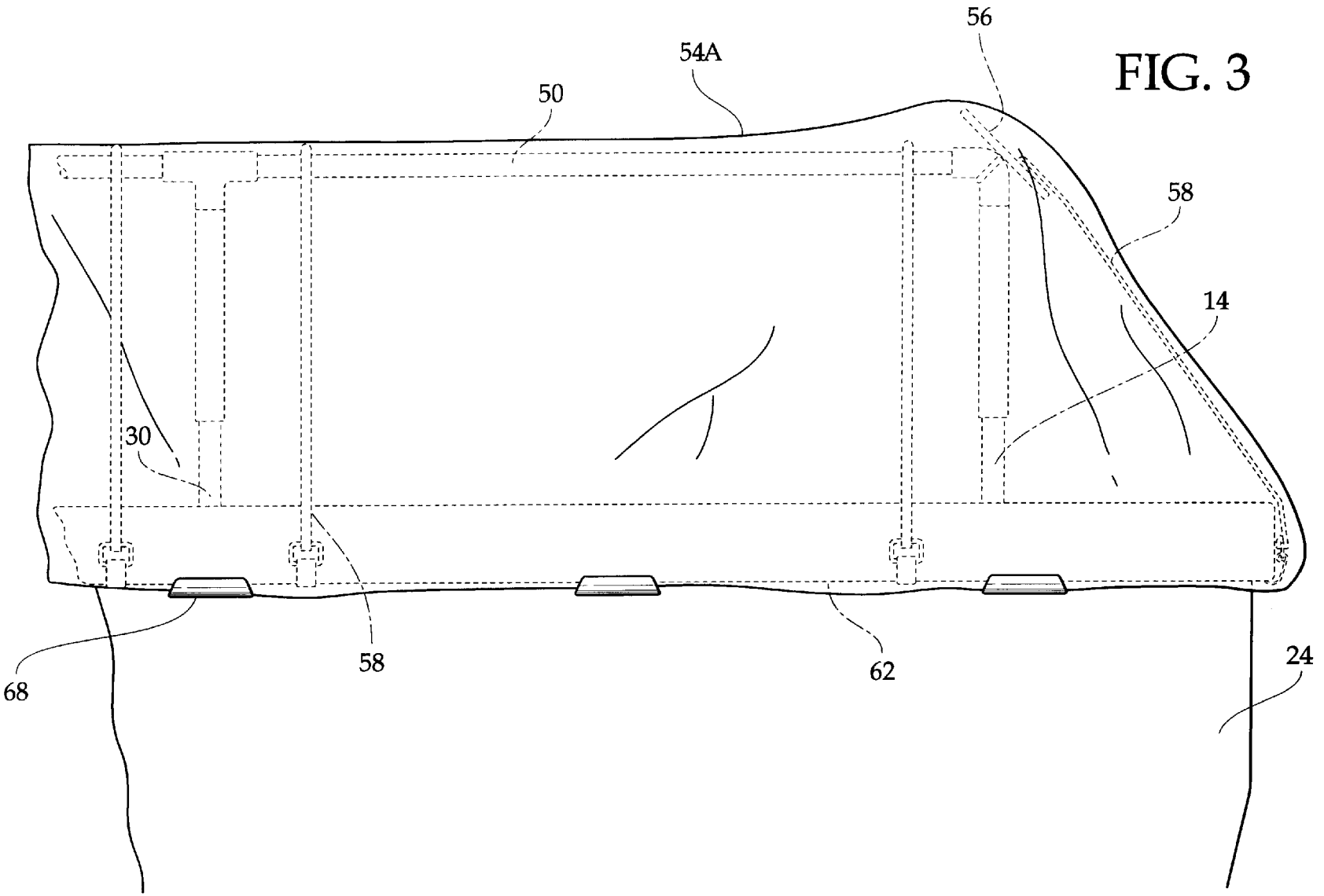
FIG. 3 is a side view of the present invention illustrated securing the pool cover to the pool.
Figure 4:
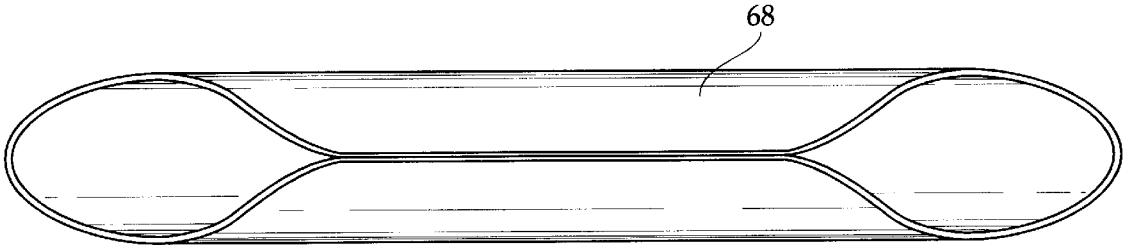
FIG. 4 is a side view of one of the securement clamps of the present invention.
Figure 5:
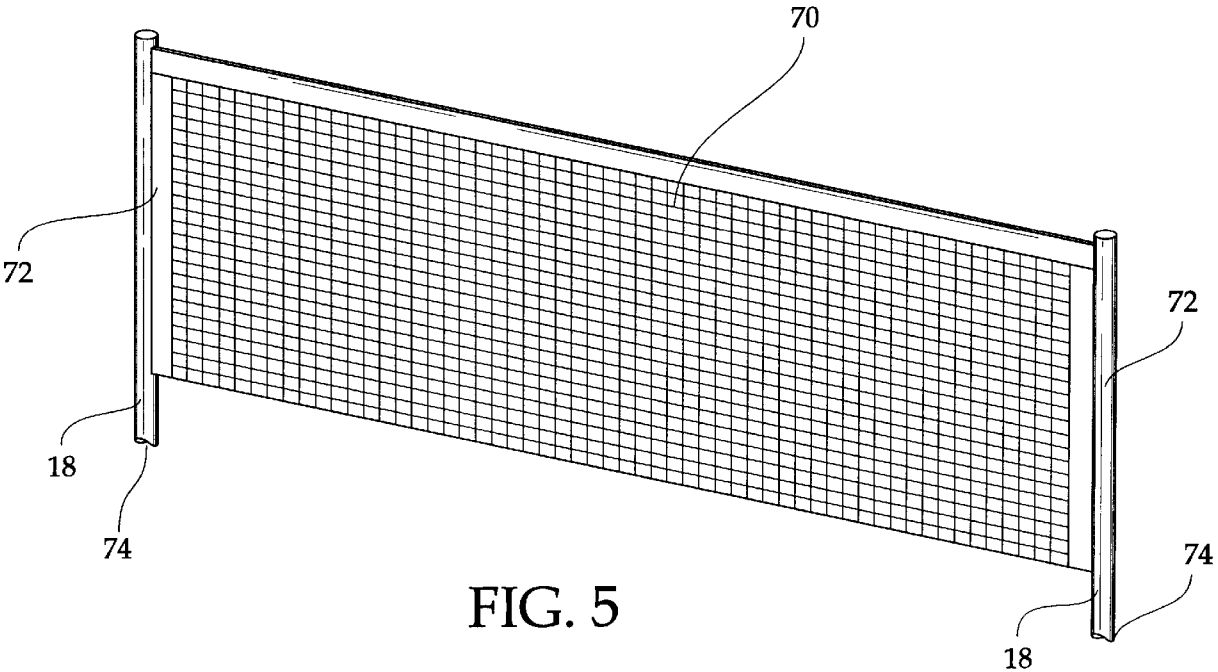
FIG. 5 is a perspective view of the present invention as the volleyball net.

With reference now to the drawings, and in particular, to FIGS. 1 through 5 thereof, the preferred embodiment of the new and improved convertible pool cover support embodying the principles and concepts of the present invention and generally designated by the reference number 10 will be described.

Specifically, it will be noted in the various Figures that the device relates to a convertible pool cover support for supporting an above-ground pool cover in an elevated position on a pool and converting into volleyball net for use in the pool. In its broadest context, the device consists of a fixed support portion, a pool cover supporting portion, a pair of corner pads, a plurality of securement straps, a plurality of securement clamps, and a volleyball net portion. Such components are individually configured and correlated with respect to each other so as to attain the desired objective.

The fixed support portion 12 is comprised of a pair of inverted T-shaped members 14. Each of the inverted T-shaped members 14 include a lower horizontal portion 16 and an upper vertical portion 18. The lower horizontal portions 16 each have a pair of anchor holes 20 therethrough. The upper vertical portions 18 each have a plurality of vertically aligned apertures 22 therethrough. The fixed support portion 12 will be used with both functions of the present invention. As used with the pool cover supporting portion, the fixed support portion 12 is positioned within the swimming pool 24. Note FIG. 2. As used with the volleyball net portion, the fixed support portion 12 is positioned outside of the swimming pool 24.

The pool cover supporting portion is comprised of a third inverted T-shaped support 26 positionable between the pair of inverted T-shaped members 14 of the fixed support portion 12. The third inverted T-shaped support 26 includes a lower horizontal portion 28 and an upper vertical portion 30. The upper vertical portion 30 has a plurality of vertically aligned apertures 32 therethrough. The pool cover supporting portion includes a pair of L-shaped members 34 each having lower vertical portions 36 and upper horizontal portions 38. The lower vertical portions 36 and the upper horizontal portions 38 each have linearly aligned apertures 40 therethrough. The lower vertical portions 36 each have open lower ends 42 for coupling with the upper vertical portions 18 of the inverted T-shaped members 14 of the fixed support member 12 with aligned apertures 22,40 thereof receiving cotter pins 44. The upper horizontal portions 38 each have open inner ends 46. The pool cover supporting portion includes a central T-shaped member 48 comprised of an upper horizontal portion 50 and a lower vertical portion 52. The upper horizontal portion 50 of the central T-shaped member 48 has linearly aligned apertures 54 therethrough and opposed ends. The opposed ends are receivable within the open inner ends 46 of the upper horizontal portions 38 of the L-shaped members 36 with the apertures 40,54 thereof aligning for receiving cotter pins 44. Note FIG. 2. Once in place, the swimming pool cover 54A can be placed over the pool cover supporting portion for securement to the pool 24. Note FIG. 2.

The pair of corner pads 56 are positionable on the pair of L-shaped members 34 of the pool cover supporting portion. The corner pads 56 have a plurality of securement straps 58 extending outwardly therefrom. The corner pads 56 will prevent the swimming pool cover 54 from being damaged while in place over the pool cover supporting portion. The securement straps 58 are each provided with clamps 60 on free ends thereof so that they can be engaged to a peripheral edge 62 of the swimming pool 24. Note FIG. 2.

The plurality of securement straps 64 are extendable over the pool cover supporting portion for securement thereof within an interior of a swimming pool 24. The securement straps 64 are preferably constructed of nylon and have hooked ends 66 that will engage the peripheral edge of the swimming pool 24. Note FIG. 2. The securement straps 64 will hold the pool cover supporting portion and the fixed support portion 12 in place during use.

The plurality of securement clamps 68 are adapted for securing the pool cover 54 to the swimming pool 24. Note FIG. 4. The clamps 68 will engage the pool cover 54 to the peripheral edge 62 of the swimming pool 24. Note FIG. 3.

The volleyball net portion 70 is adapted for coupling with the fixed support portion 12. Note FIG. 5. The volleyball net portion 70 includes a pair of vertical poles 72 each having open lower ends 74 for receiving the upper vertical portions 18 of the fixed support portion 12. To use the volleyball net portion 70, the pool cover supporting portion is simply separated from the fixed support portion 12 and set aside. The volleyball net portion 70 is then simply secured to the fixed net portion 12. Note FIG. 5. In this orientation, the fixed support portion 12 is disposed outside of the swimming pool 24. Alternatively, the volleyball net portion 70 could extend across the pool 24 to provide a volleyball net for use by people who are in the swimming pool 24.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A convertible pool cover support for supporting an above-ground pool cover in an elevated position on a pool and converting into volleyball net for use in the pool comprising, in combination:

a fixed support portion comprised of a pair of inverted T-shaped members, each of the inverted T-shaped members including a lower horizontal portion and an upper vertical portion, the lower horizontal portions having a pair of anchor holes therethrough, the upper vertical portions having a plurality of vertically aligned apertures therethrough;

a pool cover supporting portion comprised of a third inverted T-shaped support positionable between the pair of inverted T-shaped members of the fixed support portion, the third inverted T-shaped support including a lower horizontal portion and an upper vertical portion, the upper vertical portion having a plurality of vertically aligned apertures therethrough, the pool cover supporting portion including a pair of L-shaped members each having lower vertical portions and upper horizontal portions, the lower vertical portions and the upper horizontal portions each having linearly aligned apertures therethrough, the lower vertical portions each having open lower ends for coupling with the upper vertical portions of the inverted T-shaped members of the fixed support member with aligned apertures thereof receiving cotter pins, the upper horizontal portions each having open inner ends, the pool cover supporting portion including a central T-shaped member comprised of an upper horizontal portion and a lower vertical portion, the upper horizontal portion of the central T-shaped member having linearly aligned apertures therethrough and opposed ends, the opposed ends being receivable within the open inner ends of the upper horizontal portions of the L-shaped members with the apertures thereof aligning for receiving cotter pins;

a pair of corner pads positionable on the pair of L-shaped members of the pool cover supporting portion, the corner pads having a plurality of securement straps extending outwardly therefrom;

a plurality of securement straps extendable over the pool cover supporting portion for securement thereof within an interior of a swimming pool;

a plurality of securement clamps adapted for securing a pool cover to the swimming pool;

a volleyball net portion adapted for coupling with the fixed support portion, the volleyball net portion including a pair of vertical poles each having open lower ends for receiving the upper vertical portions of the fixed support portion.

2. A convertible pool cover support for supporting an above-ground pool cover in an elevated position on a pool and converting into volleyball net for use in the pool comprising, in combination:

a fixed support portion positionable within the pool;

a pool cover supporting portion couplable with the fixed support portion for supporting a pool cover at an elevation with respect to the pool;

a pair of corner pads positionable on the pool cover supporting portion, the corner pads having a plurality of securement straps extending outwardly therefrom;

a volleyball net portion adapted for coupling with the fixed support portion.

3. The convertible pool cover support as set forth in claim 2 wherein the fixed support portion is comprised of a pair of inverted T-shaped members, each of the inverted T-shaped members including a lower horizontal portion and an upper vertical portion, the lower horizontal portions having a pair of anchor holes therethrough, the upper vertical portions having a plurality of vertically aligned apertures therethrough.

4. The convertible pool cover support as set forth in claim 3 wherein the pool cover supporting portion is comprised of a third inverted T-shaped support positionable between the pair of inverted T-shaped members of the fixed support portion, the third inverted T-shaped support including a lower horizontal portion and an upper vertical portion, the upper vertical portion having a plurality of vertically aligned apertures therethrough, the pool cover supporting portion including a pair of L-shaped members each having lower vertical portions and upper horizontal portions, the lower vertical portions and the upper horizontal portions each having linearly aligned apertures therethrough, the lower vertical portions each having open lower ends for coupling with the upper vertical portions of the inverted T-shaped members of the fixed support member with aligned apertures thereof receiving cotter pins, the upper horizontal portions each having open inner ends, the pool cover supporting portion including a central T-shaped member comprised of an upper horizontal portion and a lower vertical portion, the upper horizontal portion of the central T-shaped member having linearly aligned apertures therethrough and opposed ends, the opposed ends being receivable within the open inner ends of the upper horizontal portions of the L-shaped members with the apertures thereof aligning for receiving cotter pins.

5. The convertible pool cover support as set forth in claim 2 and further including a plurality of securement straps extendable over the pool cover supporting portion for securement thereof within an interior of a swimming pool.

6. The convertible pool cover support as set forth in claim 2 and further including a plurality of securement clamps adapted for securing a pool cover to the swimming pool.

* * * * *